US005142205A

United States Patent [19]

Yabase et al.

[11] Patent Number: 5,142,205

[45] Date of Patent: Aug. 25, 1992

[54] DEFLECTION YOKE DEVICE

[75] Inventors: Koji Yabase, Urawa; Akira Iijima, Yokohama; Shinobu Ozawa, Yasu, all of Japan

[73] Assignee: Murata Mfg. Co., Ltd., Nagaokakyo, Japan

[21] Appl. No.: 643,540

[22] Filed: Jan. 22, 1991

[30] Foreign Application Priority Data

Jan. 11, 1990 [JP] Japan ..... 2-3853

[51] Int. Cl.[5] ..... H01J 29/70; H01J 29/76

[52] U.S. Cl. ..... 315/368.26; 313/412; 315/368.28

[58] Field of Search ..... 315/368, 368.26, 368.28; 313/412

[56] References Cited

U.S. PATENT DOCUMENTS 3,898,520 8/1975 Gerritsen et al. ..... 315/370
4,642,528 2/1987 Kobayashi et al. ..... 315/368
4,725,763 2/1988 Okuyama et al. ..... 315/368

*Primary Examiner*—Theodore M. Blum
*Attorney, Agent, or Firm*—Rogers, Howell & Haferkamp

[57] ABSTRACT

This invention relates to a deflection yoke device provided with a correction circuit in which horizontal and vertical misconvergences appearing on a screen of a color cathode-ray tube are corrected.

10 Claims, 12 Drawing Sheets

DEFLECTION YOKE DEVICE

BACKGROUND OF THE INVENTION

1. Field of the Invention

This invention relates to a deflection yoke device provided with a correction circuit in which horizontal and vertical misconvergences appearing on a screen of a color cathode-ray tube are corrected.

2. Description of the Prior Art

With a recent tendency to increase the resolution and size of the screen of a cathode-ray tube (to be referred to as a TV screen hereinafter) in a color TV receiver or in a color display unit, beam driving is performed by a wide-angle deflection scheme. For this reason, in order to improve focusing characteristics, both the field distributions of horizontal and vertical deflection coils tend to linear field distributions. However, if field distributions become more linear, the following misconvergence tends to appear: misconvergence $X_H$ that blue and red beams B and R ar horizontally shifted from each other on the X axis of a TV screen, as shown in FIGS. 1A and 1B; misconvergence $Y_H$ that the blue and red beams B and R are horizontally shifted from each other on the Y axis of the TV screen, as shown in FIGS. 2A and 2B; misconvergence HCR that a green beam G is horizontally shifted from the blue and red beams B and R on the X axis of the TV screen, as shown in FIGS. 3A and 3B; and misconvergence VCR that the green beam G is vertically shifted from the blue and red beams B and R on the Y axis of the TV screen, as shown in FIGS. 4A and 4B.

In order to solve such a problem, in a conventional technique, $X_H$, $Y_H$, HCR, and VCR convergence yokes for correcting the misconvergence are arranged on the neck side of a deflection yoke, independently of the deflection yoke, so that the respective misconvergence correcting operations are performed by correction currents respectively supplied from power sources independent of a power source for the deflection yoke to correction coils arranged on the corresponding convergence yokes.

In the above convergence yoke arrangement in which the correction coils are provided for the respective misconvergence correcting operations, however, a plurality of power sources for respectively supplying correction currents to the convergence yokes are required independently of the power source for the deflection yoke, resulting in a complicate arrangement and an increase in cost.

SUMMARY OF THE INVENTION

It is an object of the present invention to provide a deflection yoke device provided with a correction circuit in which horizontal misconvergence of blue and red beams on an X axis of a screen of a color cathode-ray tube is corrected without requiring a power source independent of a power source for a deflection yoke.

It is another object of the present invention to provide a deflection yoke device provided with a correction circuit in which vertical misconvergence of green beams on a Y axis of a screen of a color cathode-ray tube is corrected without requiring a power source independent of a power source for a deflection yoke.

DETAILED DESCRIPTION OF THE PREFERRED EMBODIMENTS

Embodiments of the present invention will be described below with reference to the accompanying drawings.

Figure 5:
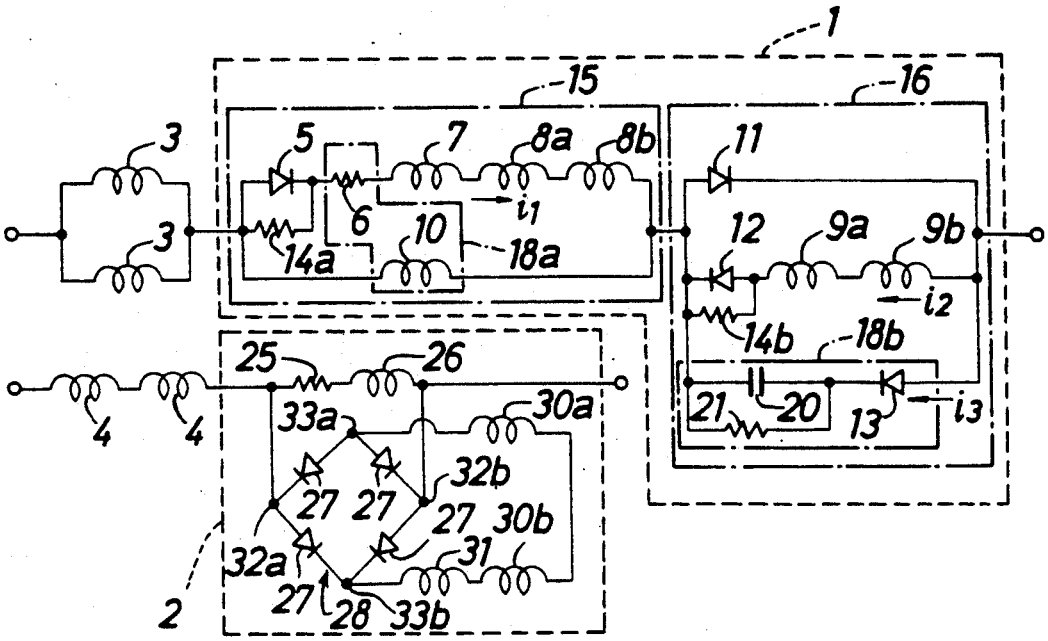
FIG. 5 is a circuit diagram showing a deflection yoke device according to the first embodiment of the present invention.
Figure 6A:
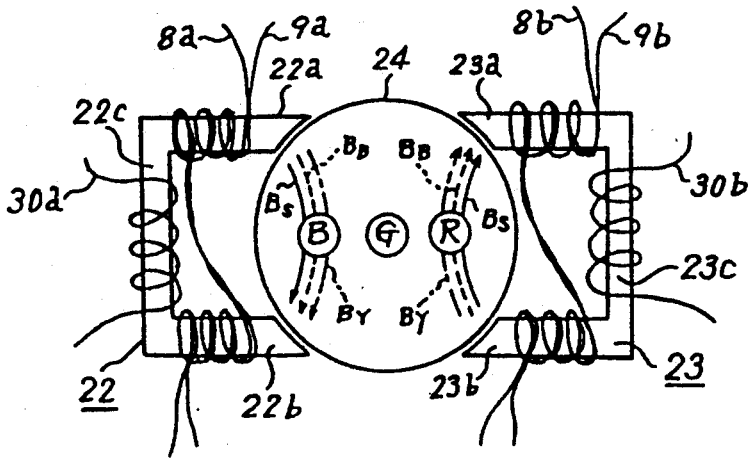
FIGS. 6A and 6B are views showing an arrangement of the respective correction coils in the first embodiment.
Figure 6B:
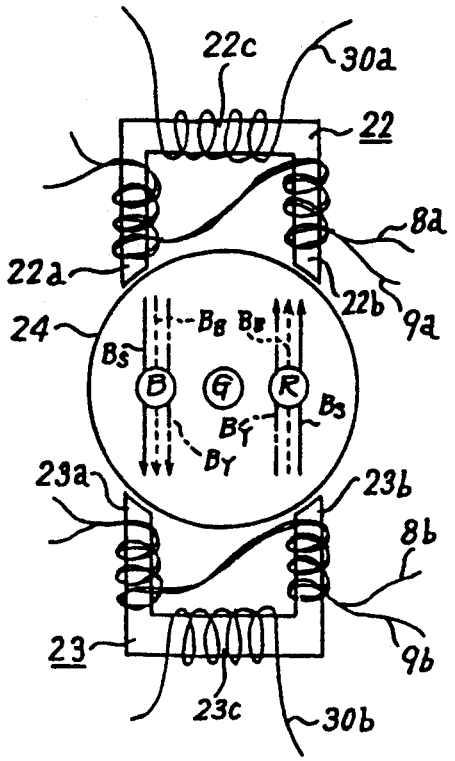

FIG. 5 and FIGS. 6A and 6B show an arrangement of a main part of a deflection yoke device according to the first embodiment of the present invention.

In the device of this embodiment, an $X_H$ correction circuit 1 for correcting misconvergence $X_H$ and a $Y_H$ correction circuit 2 for correcting misconvergence $Y_H$ are integrally formed with a deflection yoke or formed separately therefrom. Since a mechanical structure of deflection yokes having horizontal deflection coils 3 and vertical deflection coils 4 respectively mounted on the top and bottom sides of bobbins (not shown) is known, a description thereof will be omitted.

The $X_H$ correction circuit 1 is constituted by first and second correction circuits 15 and 16. The first correction circuit 15 comprises a diode 5, an attenuation resistor 6, a correction amount adjusting coil 7, first $X_H$ noise preventing resistor 14*a*. The noise preventing resistor 14*a* is connected in parallel with the diode 5. The attenuation resistor 6, the correction amount adjusting coil 7, and the first $X_H$ correction coils 8*a* and 8*b* are connected in series with the diode 5. The waveshaping coil 10 is connected in parallel with these series-connected components to constitute the first correction circuit 15. The input side of this first correction circuit 15, i.e., the anode of the diode 5 is connected in series with the horizontal deflection coils 3. Note that the attenuation resistor 6 and the waveshaping coil 10 of the circuit 15 constitute a first waveshaping circuit 18*a*.

The second correction circuit 16 comprises diodes 11 and 12, second $X_H$ correction coils 9*a* and 9*b*, a noise preventing resistor 14*b*, and a second waveshaping circuit 18*b*. The noise preventing resistor 14*b* is connected in parallel with the diode 12. The second $X_H$ correction coils 9*a* and 9*b* are connected in series with the diode 12. The diode 11 and the second waveshaping circuit 18*b* are connected in parallel with these series-connected components, thus constituting the second correction circuit 16. The second waveshaping circuit 18*b* is constituted by a diode 13, a capacitor 20, and a resistor 21. A parallel circuit constituted by the capacitor 20 and the resistor 21 is connected to the diode 13. The second correction circuit 16 is connected in series with the first correction circuit 15. The pair of diodes 5 and 12 having opposite polarities constitute a circuit for supplying correction currents. The remaining components of the $X_H$ correction circuit 1 except for the first $X_H$ correction coils 8*a* and 8*b* and the second $X_H$ correction coils 9*a* and 9*b* constitute a correction current forming circuit.

The $Y_H$ correction circuit 2 comprises a sensitivity adjusting resistor 25, a waveform correcting coil 26, a bridge rectifier 28 constituted by four diodes 27, $Y_H$ correction coils 30*a* and 30*b*, and a mutual interference preventing coil 31. An input terminal 32*a* of the bridge rectifier 28 is connected to the vertical deflection coils 4. A series circuit constituted by the sensitivity adjusting resistor 25 and the waveform correcting coil 26 is connected between the input terminal 32*a* and an input terminal 32*b*. A series circuit constituted by the $Y_H$ correction coils 30*a* and 30*b* and the mutual interference preventing coil 31 is connected between output terminals 33*a* and 33*b* of the bridge rectifier 28.

Figure 7A:
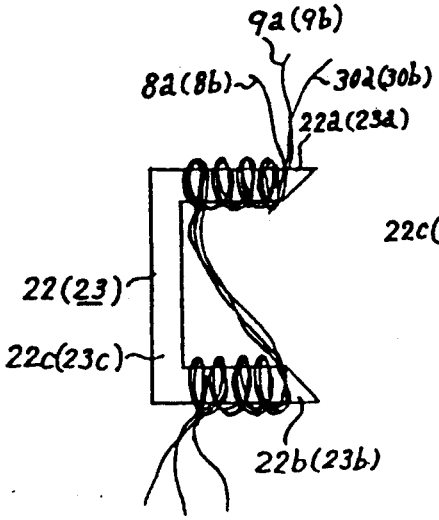
FIGS. 7A and 7B are views showing another arrangement of the respective correction coils with respect to cores in the first embodiment.
Figure 7B:
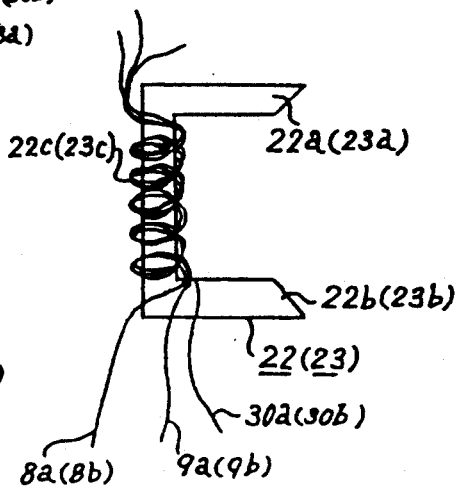

The first $X_H$ correction coils 8*a* and 8*b*, the second $X_H$ correction coils 9*a* and 9*b*, and the $Y_H$ correction coils 30*a* and 30*b* are formed by winding windings around common cores. In this embodiment, as shown in FIGS. 6A and 6B, the windings are wound around U-shaped cores 22 and 23 which are arranged at left and right positions or upper and lower positions of a neck portion 24 of the deflection yoke so as to oppose each other. More specifically, two windings are wound together around leg portions 22*a* and 22*b* of the core 22 in a bifilar manner to form the first $X_H$ correction coil 8*a* and the second $X_H$ correction coil 9*a*. A winding is wound around a bottom portion 22*c* of the core 22 to form the $Y_H$ correction coil 30*a*. Similarly, two windings are wound around leg portions 23*a* and 23*b* of the core 23 in a bifilar manner to form the first and second $X_H$ correction coils 8*b* and 9*b*. Another winding is wound around a bottom portion of the core 23 to form the $X_H$ correction coil 30*b*. These coils can be wound in various forms. For example, the $X_H$ correction coils 8*a*, 8*b*, 9*a*, and 9*b* may be formed on the bottom portions 22*c* and 23*c* of the cores 22 and 23, while windings are wound around the leg portions 22*a*, 22*b*, 23*a*, and 23*b* to form the $Y_H$ correction coils 30*a* and 30*b*. Alternatively, the respective $X_H$ correction coils need not be wound in a bifilar manner and may be separately wound at different positions. Furthermore, as shown in FIG. 7, the $X_H$ and $Y_H$ correction coils may be wound around the leg or bottom portions of the cores in a bifilar manner.

Figure 8:
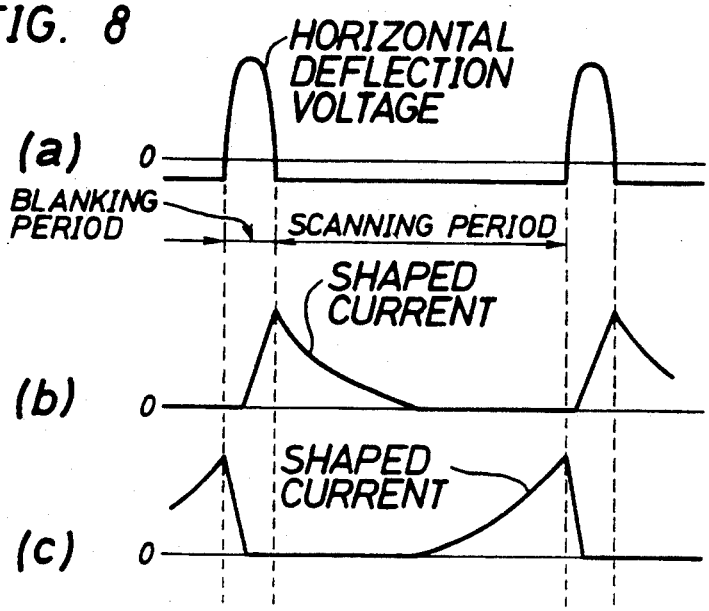
FIGS. 8(*a*) to 8(*c*) are timing charts showing an example of formation of correction currents together with a horizontal deflection voltage in the first embodiment.

The first $X_H$ correction coils 8*a* and 8*b* are connected to each other in such a manner that when receiving correction currents shown in FIG. 8(*b*), they generate first correction fields $B_S$ which cross a blue beam B from the top side to the bottom side and cross a red beam R from the bottom side to the top side, as shown in FIGS. 6A and 6B. The second $X_H$ correction coils 9*a* and 9*b* are connected to each other in such a manner that when receiving correction currents shown in FIG. 8(*c*), they generate second correction fields $B_B$ in the same directions as those of the first correction fields $B_S$, as indicated by dotted lines in FIGS. 6A and 6B. Furthermore, in this embodiment, design values, e.g., the number of turns, of the first and second $X_H$ correction coils are determined in relation to each other so as to set the first and second correction fields $B_S$ and $B_B$, which are respectively generated by the first and second $X_H$ correction coils 8*a* and 8*b*, and 9*a* and 9*b*, to be equal to each other (to be horizontally symmetrical on the TV screen). The intensity of the first correction field $B_S$ can be adjusted by changing the inductance of the correction amount adjusting coil 7. More specifically, if the inductance of the correction amount adjusting coil 7 is increased, currents flowing in the first $X_H$ correction coils 8*a* and 8*b* are reduced, and the intensity of each first correction field $B_S$ is also reduced. In contrast to this, if the inductance of the correction amount adjusting coil 7 is decreased, currents flowing in the coils 8*a* and 8*b* are increased, and the intensity of each first correction field $B_S$ is also increased. The correction amount adjusting coil 7 can be constituted not only by a fixed inductance coil as shown in FIG. 5 but also by a variable inductance coil.

Figure 10:
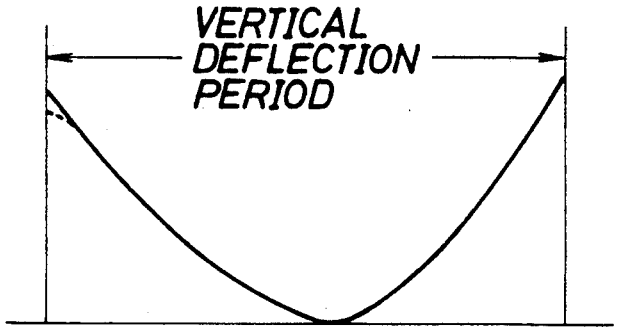
FIG. 10 is a graph for explaining the waveform of a correction current for misconvergence $Y_H$.

The $Y_H$ correction coils 30*a* and 30*b* are connected to each other in such a manner that when receiving parabolic correction currents shown in FIG. 10, they generate correction fields $B_Y$ which cross the blue beam B from the top side to the bottom side and cross the red beam R from the bottom side to the top side.

The first embodiment has the above-described arrangement. Misconvergence $X_H$ and misconvergence $Y_H$ correcting operations will be described below. A misconvergence $X_H$ correcting operation will be described first.

Figure 9:
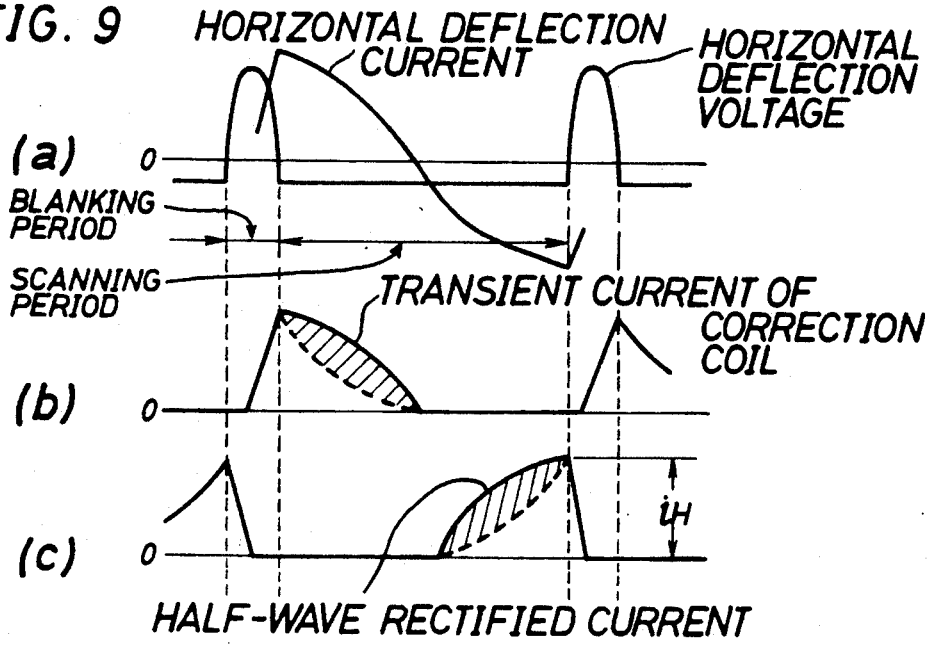
FIGS. 9(*a*) to 9(*c*) are timing charts showing a wave-shaped correction current together with a horizontal deflection voltage.

When the deflection yoke is driven, a horizontal deflection current having a sawtooth waveform shown in FIG. 9(*a*) is supplied from the horizontal deflection coils 3 to the $X_H$ correction circuit 1. In this case, the diode 5 is turned on when the horizontal deflection pulse shown in FIG. 9(*a*) becomes a forward voltage (when the horizontal deflection voltage becomes positive), i.e., at the start point of a blanking period. As a result, the $X_H$ correction circuit 1 generates a transient current having a peak value at the start point of a scanning period and becoming zero at a middle point of the scanning period, as shown in FIG. 9(*b*), by using a transient phenomenon of the current flowing in each of the first $X_H$ correction coils 8*a* and 8*b*. At this time, the noise preventing resistor 14*a* removes noise from the diode 5 or ringing noise. Since the transient current falls to zero during a scanning period for the right half of the TV screen, the diode 5 is turned off, and the diode 12 is forward-biased and turned on. As a result, as indicated by a solid line in FIG. 9(*c*), a half-wave rectified current half-wave-rectified by the diode 12 is supplied to the second $X_H$ correction coils 9*a* and 9*b*. At this time, the noise preventing resistor 14*b* removes noise from the diode 12 or ringing noise.

Figure 1A:
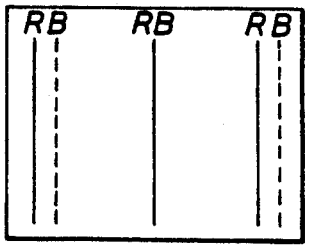
FIG. 1A shows misconvergence $X_H$ of under-type in which beams of blue B and red R are horizontally shifted to each other on an X axis of a screen of a color cathode-ray tube and FIG. 1B shows misconvergence $X_H$ of over-type of the same kind.

As described above, the transient current generated by the pulse voltage rectifying function of the diode and by the transient phenomenon of the current flowing in each of the coils 8*a* and 8*b* is supplied to the first $X_H$ correction coils 8*a* and 8*b* as a correction current during the scanning period for the left half of the TV screen. As a result, as shown in FIGS. 6A and 6B, the coils 8*a* and 8*b* generate the first correction fields $B_S$ which vertically cross the blue and red beams B and R in opposite directions. During the scanning period for the right half of the TV screen, the half-wave rectified current obtained by the diode 12 is supplied to the second $X_H$ correction coils 9*a* and 9*b* as a correction current. As a result, as indicated by the dotted lines in FIGS. 6A and 6B, the coils 9*a* and 9*b* generate the second correction fields $B_B$ in the same directions as those of the correction fields during the scanning period for the left half of the TV screen. The blue and red beams B and R respectively receive forces in the right direction with respect to the direction of these correction fields and are moved in the right direction. As a result, correction of under-misconvergence $X_H$ as shown in FIG. 1A is performed.

Figure 11:
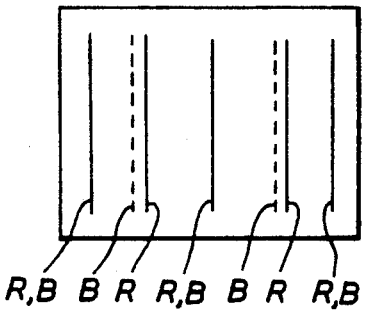
FIG. 11 is a view showing a pattern in which over-correction of misconvergence $X_H$ occurs at left and right middle portions of a TV screen when correction is performed by using a half-wave rectified current.

In general, a horizontal deflection current is subjected to S-shaped correction as shown in FIG. 9(*a*) in order to correct horizontal linearity on the TV screen (i.e., linearity characterized in that a pattern is increased toward left and right peripheral portions of the TV screen). For this reason, a half-wave rectified current has a waveform which is expanded with respect to an ideal parabolic waveform to be slightly round, as indicated by solid lines in FIG. 9(*b*) and 9(*c*). Therefore, if correction currents shown in FIG. 9(*b*) and 9(*c*) are used to correct the misconvergence $X_H$, expanded portions of half-wave rectified waveforms appear, i.e., middle portions of the left and right halves of the TV screen are subjected to overcorrection, as shown in FIG. 11. As a result, over-misconvergence appears at these middle portions.

In order to solve such a problem, according to this embodiment, a correction current waveform is corrected by the first waveshaping circuit 18*a* during a scanning period for the left half of the TV screen, whereas a correction current waveform is corrected by the second waveshaping circuit 18*b* during a scanning period for the right half of the TV screen. With such correction, occurrence of the above-mentioned overcorrection state is reliably prevented. More specifically, during a scanning period for the left half of the TV screen, a transient current is supplied from the diode 5 to the first waveshaping circuit 18*a*. In the first waveshaping circuit 18*a*, the transient current waveform is shaped into a parabolic waveform indicated by a hatched portion in FIG. 9(*b*) by means of the waveshaping function of the waveshaping coil 10 of a fixed or variable type and the attenuation function of the attenuation resistor 6. That is, the hatched portion is removed from the transient current waveform. The degree of a curve on this parabolic waveform is increased with an increase in resistance value of the attenuation resistor 6. Therefore, by variably adjusting the resistance value of the attenuation resistor 6, the transient current waveform can be shaped into the ideal parabolic waveform indicated by the hatched portion. The current which is shaped to have the parabolic waveform by the attenuation resistor 6 is subjected to correction amount adjustment in the correction amount adjusting coil 7. If the inductance of the correction amount adjusting coil 7 is increased, the correction amount is reduced, and vice versa. The current subjected to correction amount adjustment in the correction amount adjusting coil 7 is supplied, as an ideal parabolic correction current shown in FIG. 8(*b*), to the first $X_H$ correction coils 8*a* and 8*b*. With this operation, the under-misconvergence $X_H$ can be corrected with a high sensitivity and a high resolution without causing overcorrection at a middle portion of the left half of the TV screen.

During a scanning period for the right half of the TV screen, the half-wave rectified current indicated by the solid line in FIG. 9(*c*) is shunted into a current $i_2$ supplied to the second $X_H$ correction coils 9*a* and 9*b* and a current $i_3$ is supplied to the second waveshaping circuit 18*b*. The charge of the capacitor 20 is set to be 0 at the start time of scanning on the right half of the TV screen and is increased as the shunt current $i_3$ flows. With this increase in charge, the proportion of the shunt current $i_3$ on the second waveshaping circuit 18*b* side is gradually reduced. With this reduction, the proportion of the current $i_2$ flowing in the second $X_H$ correction coils 9*a* and 9*b* is increased. That is, when the shunt current $i_3$ flows in the second waveshaping circuit 18*b*, the hatched portion of the half-wave rectified waveform indicated by the solid line in FIG. 9(*c*) is removed by the current $i_3$. As a result, a correction current having the ideal parabolic waveform indicated by the dotted line in FIG. 9(*c*), i.e., shown in FIG. 8(*c*), is formed and is supplied to the second $X_H$ correction coils 9*a* and 9*b*. With this operation, the under-misconvergence $X_H$ can be corrected with a high sensitivity and a high resolution without causing overcorrection at a middle portion of the right half of the TV screen. Note that in this waveshaping operation by the second waveshaping circuit 18*b*, the degree of a parabolic curve on a correction current can be variably adjusted by adjusting the capacitance of the capacitor 20.

During a scanning period for the left half of the TV screen, the first waveshaping circuit 18*a* is operated to perform a waveshaping operation in the same manner as described above. At this time, the charge which is stored in the capacitor 20 through the resistor 21 is discharged in the second waveshaping circuit 18*b*, thus preparing for the next scanning operation for the right half of the TV screen.

Figure 1B:
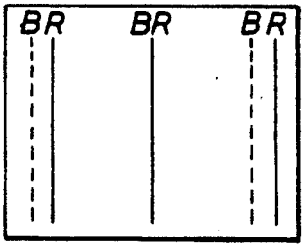

In this embodiment, if the first $X_H$ correction coils 8a and 8b, and the second $X_H$ correction coils 9a and 9b are simultaneously connected in a direction opposite to the connecting direction described above, the directions of the correction fields $B_S$ and $B_B$ are reversed. With this operation, over-misconvergence $X_H$ shown in FIG. 1B can be corrected in the same manner as described above.

Figure 2A:
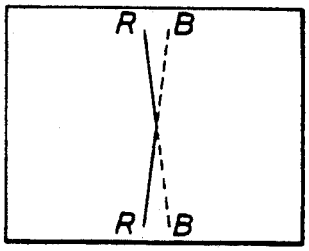
FIG. 2A shows misconvergence $Y_H$ of under-type in which beams of blue B and red R are horizontally shifted to each other on an Y axis of a screen of a color cathode-ray tube and FIG. 2B shows misconvergence $Y_H$ of over-type of the same kind.
Figure 2B:
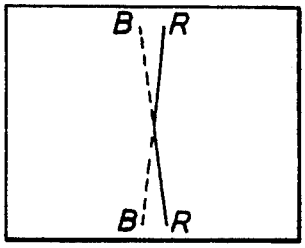

Correction of the misconvergence $Y_H$ will be described below. The deflection yoke is driven to supply a vertical deflection current from the vertical deflection coil 4 to the bridge rectifier 28. The bridge rectifier 28 performs full-wave rectification of the vertical deflection current to form a parabolic correction current shown in FIG. 10. When the parabolic waveform formed by the bridge rectifier 28 at this time is strictly evaluated, it is found that an upper end portion of the waveform is slightly rounded, as indicated by a dotted line in FIG. 10. If the waveform is rounded in this manner, an uppermost portion of the TV screen is lacking in correction amount, and the misconvergence $Y_H$ cannot be accurately corrected. In order to eliminate such inconvenience, the waveform correcting coil 26 is provided. The coil 26 applies a voltage corresponding to the rounded portion through a blanking pulse at an uppermost portion of a vertical deflection period, thus correcting the correcting current to form an ideal parabolic waveform, as indicated by the solid line in FIG. 10. The waveform-corrected correction current $Y_H$ is supplied to the $Y_H$ correction coils 30a and 30b. Upon reception of the correction current, the $Y_H$ correction coils 30a and 30b generate correction fields $B_Y$ which cross the blue beam B from the top side to the bottom side and cross the red beam R from the bottom side to the top side, thereby applying forces to these beams in a right direction with respect to the propagation directions of the correction fields $B_Y$. As a result, the blue and red beams B and R are moved in the left and right directions, respectively, so as to perform correction of under-misconvergence $Y_H$ shown in FIG. 2B. In this case, if the $Y_H$ correction coils 30a and 30b are simultaneously connected in a direction opposite to the connecting direction described above, the direction of the correction field $B_Y$ is reversed. As a result, over-misconvergence $Y_H$ shown in FIG. 2B can be corrected.

If the $X_H$ correction coils 8a, 8b, 9a, and 9b and the $Y_H$ correction coils 30a and 30b are formed on the common cores 22 and 23 as in this embodiment, mutual interference, e.g., induction of a current in the $Y_H$ correction circuit 2 due to a correction current in the $X_H$ correction circuit 1, may occur. Assume that the mutual interference preventing coil 31 is not arranged. In this case, when the $X_H$ correction circuit 1 is operated, magnetic fluxes from the $X_H$ correction coils 8a, 8b, 9a, and 9b pass through the cores 22 and 23, and the $Y_H$ correction circuit 2 connected to the $Y_H$ correction coils 30a and 30b acts as a load. As a result, the normal operation of the $X_H$ correction circuit 1 is impaired. The mutual interference preventing coil 31 increases the impedance of the $Y_H$ correction circuit 2 to prevent the circuit 2 from acting as a load when the $X_H$ correction circuit 1 is operated, thus effectively preventing mutual interference between the $X_H$ and $Y_H$ correction circuits 1 and 2.

Figure 12:
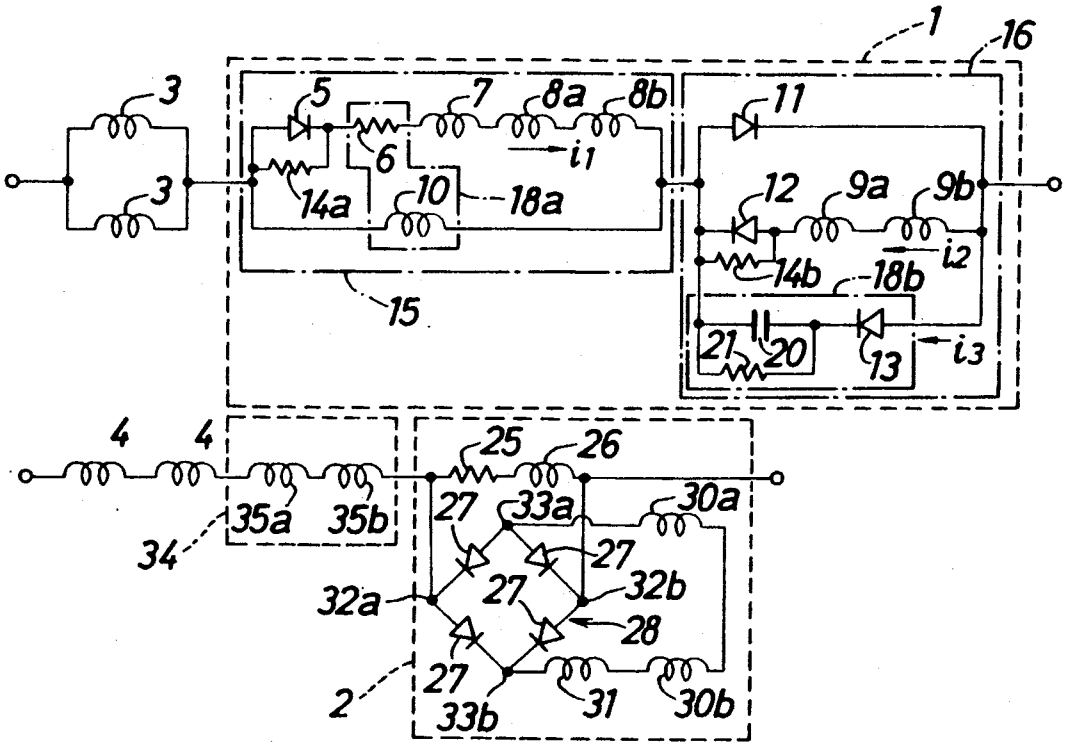
FIG. 12 is a circuit diagram showing a deflection yoke device according to the second embodiment of the present invention.
Figure 13:
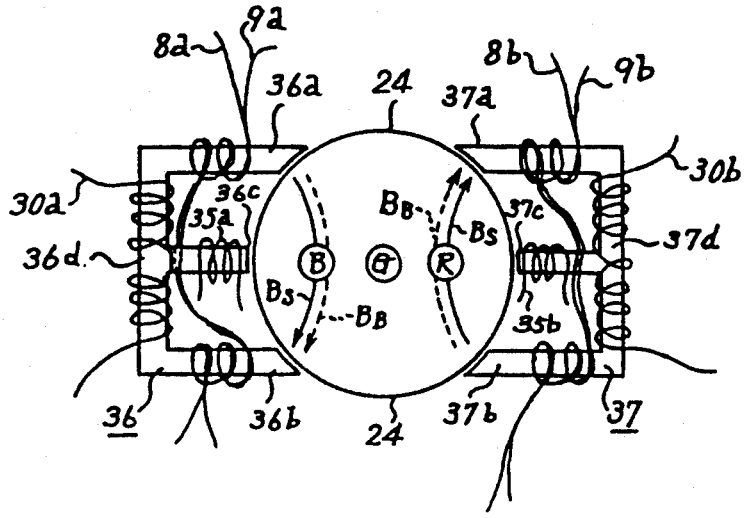
FIG. 13 is a view showing an arrangement of correction coils in the second embodiment.

FIGS. 12 and 13 show a deflection yoke device according to the second embodiment of the present invention. The second embodiment is different from the first embodiment in that a VCR correction circuit 34 is connected in series with vertical deflection coils 4 and the $Y_H$ correction circuit 2. Other arrangements of the second embodiment are the same as those of the first embodiment. The same reference numerals in the second embodiment denote the same circuit components as in the first embodiment. The VCR correction circuit 34 is constituted by series connected VCR correction coils 35a and 35b. In the second embodiment, E-shaped cores 36 and 37 are used, which are arranged on the left and right sides of a neck portion 24 of the deflection yoke with their leg portions facing inside. First and second $X_H$ correction coils 8a and 9a are wound around outer leg portions 36a and 36b of the E-shaped core 36. The VCR correction coil 35a is wound around an intermediate leg portion 36c. A $Y_H$ correction coil 30a is wound around a bottom portion 36d. Similarly, first and second $X_H$ correction coils 8b and 9b are wound around outer leg portions 37a and 37b of the E-shaped core 37. The VCR correction coil 35b is wound around an intermediate leg portion 37c. A $Y_H$ correction coil 30b is wound around a bottom portion 37d. The VCR correction coils 35a and 35b are connected to each other in such a manner that when receiving positive components of a vertical deflection current, they generate a correction field $B_{VCR}$ extending from the intermediate leg portion 36c to the outer leg portions 36a and 36b on the E-shaped core 36 side, and generate a correction field $B_{VCR}$ extending from the outer leg portions 37a and 37b to the intermediate leg portion 37c.

Figure 4A:
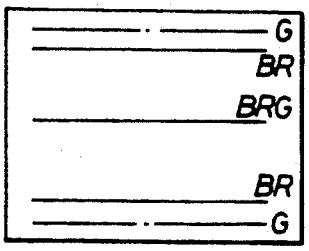
FIG. 4A shows misconvergence VCR of wide-type in which a beam of green G is vertically shifted with respect to beams of blue B and red R on an X axis of a screen of a color cathode-ray tube and FIG. 4B shows misconvergence VCR of narrow-type of the same kind.
Figure 4B:
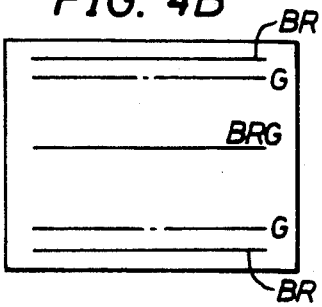
Figure 14:
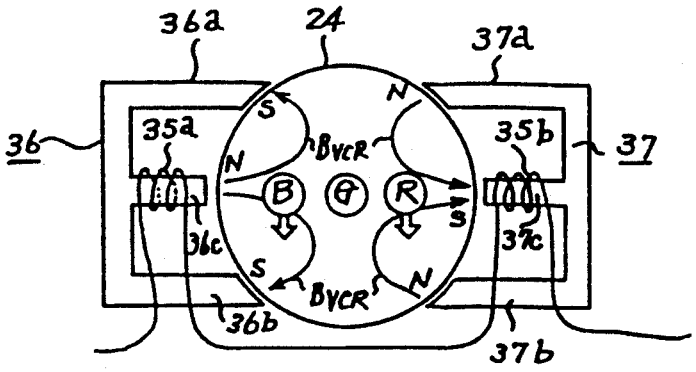
FIG. 14 is a view for explaining a correcting operation of misconvergence VCR.

In the second embodiment, when the upper half of the TV screen is to be scanned, a positive component of a vertical deflection current is supplied to the VCR correction coils 35a and 35b. The VCR correction coils 35a and 35b then generate the correction fields $B_{VCR}$ in directions shown in FIG. 14. Blue and red beams B and R receive downward forces and are moved downward. As a result, a green beam G is relatively moved upward with respect to the blue and red beams B and R. Since the polarity of the vertical deflection current becomes negative during a scanning period for the lower half of the TV screen, the directions of the correction fields $B_{VCR}$ are reversed, and the blue and red beams B and R are moved upward. As a result, the green beam G is relatively moved downward with respect to the blue and red beams B and R. With this operation, misconvergence VCR in a narrowing direction of the TV screen shown in FIG. 4B is corrected. If the VCR correction coils 35a and 35b are simultaneously connected in a direction opposite to the connecting direction described above, the direction of the correction current (the vertical deflection current flowing in the VCR correction coils 35a and 35b) is reversed, and the directions of the correction fields $B_{VCR}$ are reversed. As a result, misconvergence VCR in a widening direction of the TV screen shown in FIG. 4A can be corrected. In the second embodiment, the misconvergence $X_H$, the misconvergence $Y_H$, and the misconvergence VCR are corrected at once.

Figure 15:
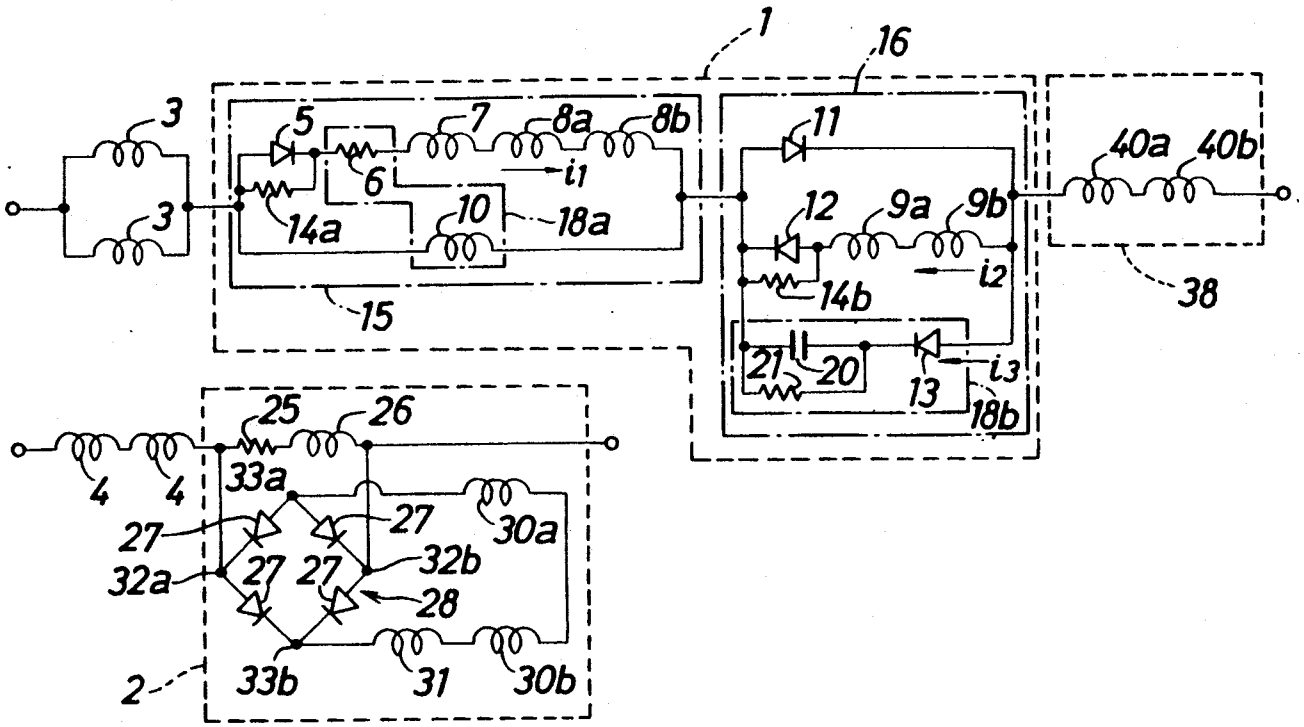
FIG. 15 is a circuit diagram showing a deflection yoke according to the third embodiment of the present invention.
Figure 16:
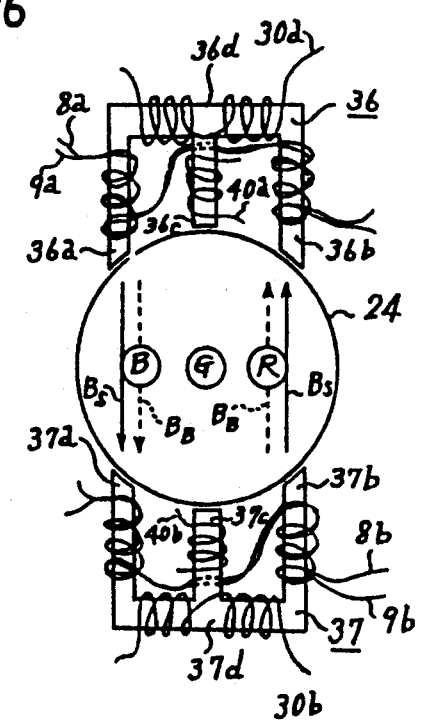
FIG. 16 is a view showing an arrangement of correction coils in the third embodiment.
Figure 17:
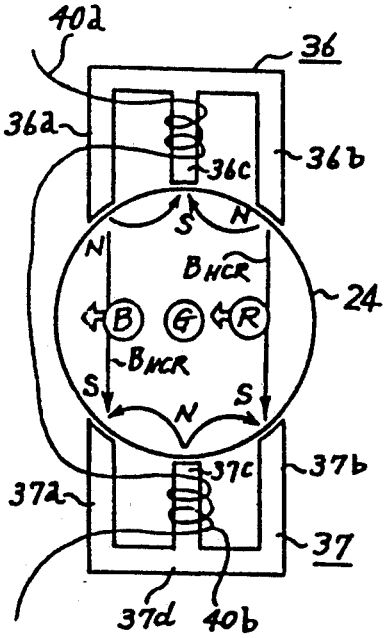
FIG. 17 is a view for explaining a correction operation of misconvergence HCR.

FIGS. 15 and 16 show a deflection yoke device according to the third embodiment of the present invention. The third embodiment is different from the first embodiment in that an HCR correction circuit 38 is connected in series with an $X_H$ correction circuit 1. The HCR correction circuit 38 is constituted by a series circuit consisting of HCR correction coils 40a and 40b. Similar to the second embodiment, the third embodiment employs E-shaped cores 36 and 37. As shown in FIG. 16, the E-shaped cores 36 and 37 are arranged on the upper and lower sides of a neck portion 24 of a deflection yoke with their leg portions facing inside. First and second $X_H$ correction coils 8*a* and 9*a* are wound around outer leg portions 36*a* and 36*b* of the E-shaped core 36. The HCR correction coil 40*a* is wound around an intermediate leg portion 36*c*. A $Y_H$ correction coil 30*a* is wound around a bottom portion 36*d*. Similarly, first and second $X_H$ correction coils 8*b* and 9*b* are wound around outer leg portions 37*a* and 37*b* of the E-shaped core 37. The HCR correction coil 40*b* is wound around an intermediate leg portion 37*c*. A $Y_H$ correction coil 30*b* is wound around a bottom portion 37*d*. The HCR correction coils 40*a* and 40*b* are connected in such a manner when receiving positive components of a horizontal deflection current, the intermediate leg portions 36*c* and 37*c* of the E-shaped cores 36 and 37 are magnetized to the S and N poles, respectively, as shown in FIG. 17.

Figure 3A:
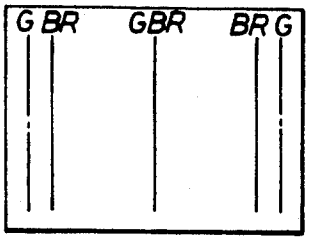
FIG. 3A shows misconvergence HCR of wide-type in which a beam of green G is horizontally shifted with respect to beams of blue B and red R on an X axis of a screen of a color cathode-ray tube and FIG. 3B shows misconvergence HCR of narrow-type of the same kind.
Figure 3B:
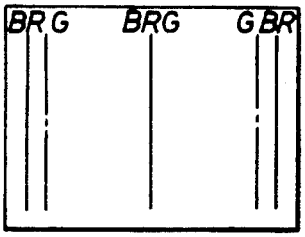

In the third embodiment, when the deflection yoke is driven, positive components of a horizontal deflection current (sawtooth waveform) are supplied to the HCR correction coils 40*a* and 40*b* during a scanning period for the left half of the TV screen, thus magnetizing the outer leg portions 36*a* and 36*b* of the E-shaped core 36 to the N and S poles, respectively. In addition, the outer leg portions 37*a* and 37*b* of the E-shaped core 37 are magnetized to the S pole while the intermediate leg portion 37*c* is magnetized to the N pole. As a result, as shown in FIG. 17, a correction fields $B_{HCR}$ is generated from the outer leg portions 36*a* and 36*b* toward the opposing outer leg portions 37*a* and 37*b*. The correction fields $B_{HCR}$ cross blue and red beams B and R from the top side to the bottom side. Upon reception of leftward magnetic forces from the correction fields $B_{HCR}$, the blue and red beams B and R are moved leftward. As a result, a green beam G is relatively moved rightward with respect to the blue and red beams B and R. Since the polarity of the horizontal deflection current is reversed during a scanning period for the right half of the TV screen, the magnetization polarities of the E-shaped cores 36 and 37 are reversed to reverse the direction of the correction fields $B_{HCR}$. Consequently, the blue and red beams B and R receive rightward forces and are moved rightward. The green beam G is relatively moved leftward with respect to the blue and red beams B and R. With this operation, misconvergence HCR in a widening direction of the TV screen shown in FIG. 3A is corrected. If the HCR correction coils are simultaneously connected in a direction opposite to the connecting direction described above, the horizontal deflection currents flow in the opposite directions, and the correction field $B_{HCR}$ flows in a direction opposite to that in the above case. Therefore, misconvergence HCR in a narrowing direction of the TV screen shown in FIG. 3B can be corrected. In the third embodiment, correction of the misconvergence $X_H$, the misconvergence $Y_H$, and the misconvergence HCR is performed at once.

Figure 18:
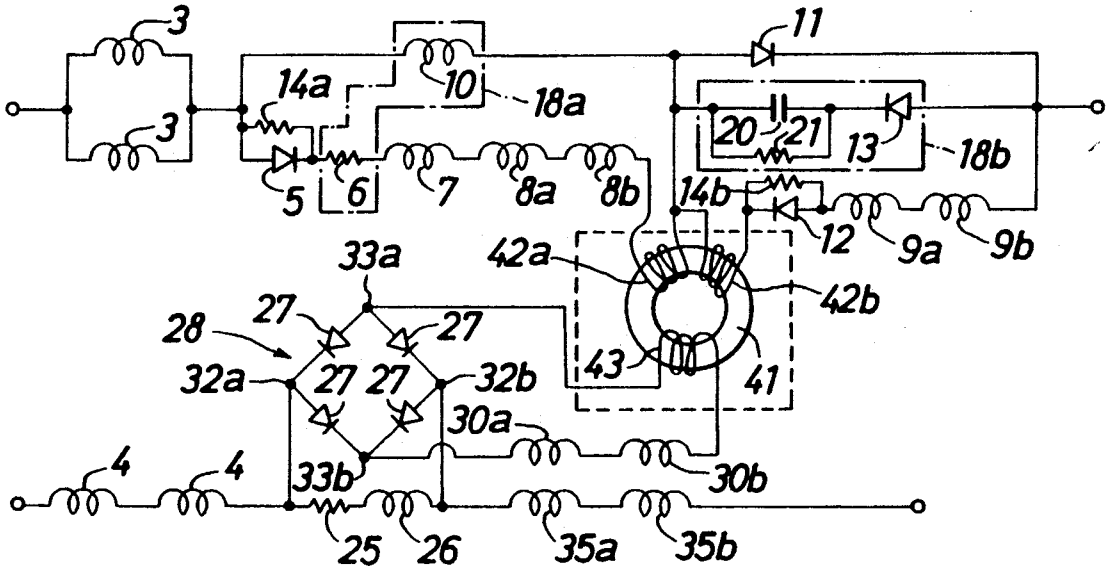
FIGS. 18 and 19 are circuit diagrams showing other means for preventing mutual interference between $X_H$ and $Y_H$ correction circuits.

The present invention is not limited to the above-described embodiments. Various changes and modifications of the present invention can be made. For example, the following modifications can be made. In the respective embodiments described above, mutual interference between the $X_H$ and $Y_H$ correction circuits 1 and 2 is prevented by the mutual interference preventing coil 31. However, as shown in FIG. 18, this prevention may be performed by a transformer arrangement. The circuit shown in FIG. 18 is designed such that primary windings 42*a* and 42*b* and a secondary winding 43 are wound around a ring-like core 41. The primary winding 42*a* is connected in series with first $X_H$ correction coils 8*a* and 8*b*, whereas the primary winding 42*b* is connected in series with connected in series with $Y_H$ correction coils 30*a* and 30*b*. In the circuit shown in FIG. 18, induction of an $X_H$ correction current in a $Y_H$ correction circuit 2 which is caused by an $X_H$ correction circuit 1 is prevented as follows. During a scanning period for the left half of a TV screen, the primary winding 42*a* is caused to induce a cancel current in the secondary winding 43 to cancel a correction current induced in the $Y_H$ correction circuit 2 by the $X_H$ correction circuit 1. Similarly, during a scanning period for the right half of the TV screen, the primary winding 42*b* is caused to induce a cancel current in the secondary winding 43 to cancel a correction current induced in the $Y_H$ correction circuit 2 by the $X_H$ correction circuit 1. By canceling mutual interference between the $X_H$ and $Y_H$ correction circuits 1 and 2 by means of the transformer arrangement in this manner, a mutual interference preventing effect larger than that obtained by the mutual interference preventing coil 31 can be achieved. Note that the core 41 is not limited to a ring-like shape and may have any shape as long as it constitutes a transfer arrangement.

Figure 19:
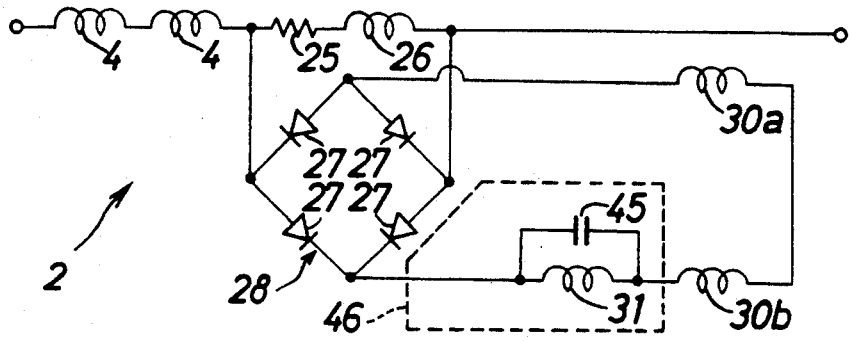

In addition, in each of the circuits shown in FIGS. 1, 12, and 15, while an $X_H$ correction circuit 1 having the same arrangement as that shown in each drawing is used, a capacitor 45 may be connected in parallel with the mutual interference preventing coil 31 of the $Y_H$ correction circuit 2 to constitute an LC parallel resonator 46, as shown in FIG. 19, so that mutual interference between the $X_H$ and $Y_H$ correction circuits 1 and 2 can be prevented by the resonator 46. This LC parallel resonator 46 is designed such that parallel resonance thereof is performed at the frequency of a horizontal parabolic current induced in correction coils 30*a* and 30*b* to increase the impedance of the resonator 46, thereby preventing mutual interference between the $X_H$ and $Y_H$ correction circuits 1 and 2.

Figure 20:
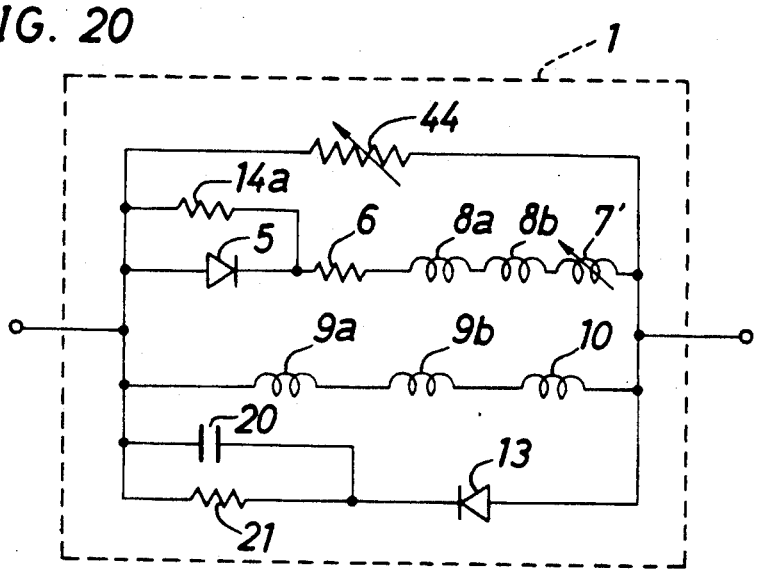
FIGS. 20 to 22 are circuit diagrams showing other $X_H$ correction circuits which can be applied to the respective embodiments of the present invention.

Furthermore, the $X_H$ correction circuit in each of the embodiments may have various circuit arrangements. For example, circuit arrangements shown in FIGS. 20 to 22 may be employed. In an $X_H$ correction circuit 1 shown in FIG. 20, a series circuit consisting of a diode 5, an attenuation resistor 6, first $X_H$ coils 8*a* and 8*b*, and a correction amount adjusting coil 7' of a variable inductance type, a series circuit consisting of second $X_H$ correction coils 9*a* and 9*b* and a waveshaping coil 20, a series circuit consisting of a resistor 21 and a diode 13, and a variable resistor 44 are connected in parallel, and a noise preventing resistor 14*a* is connected in parallel with the diode 5, as in each embodiment described above. In this circuit, the total inductance of the second $X_H$ correction coils 9*a* and 9*b* and the waveshaping coil 10 is set to a constant value at which a correction current becomes 0 at a middle position on a TV screen.

Figure 23:
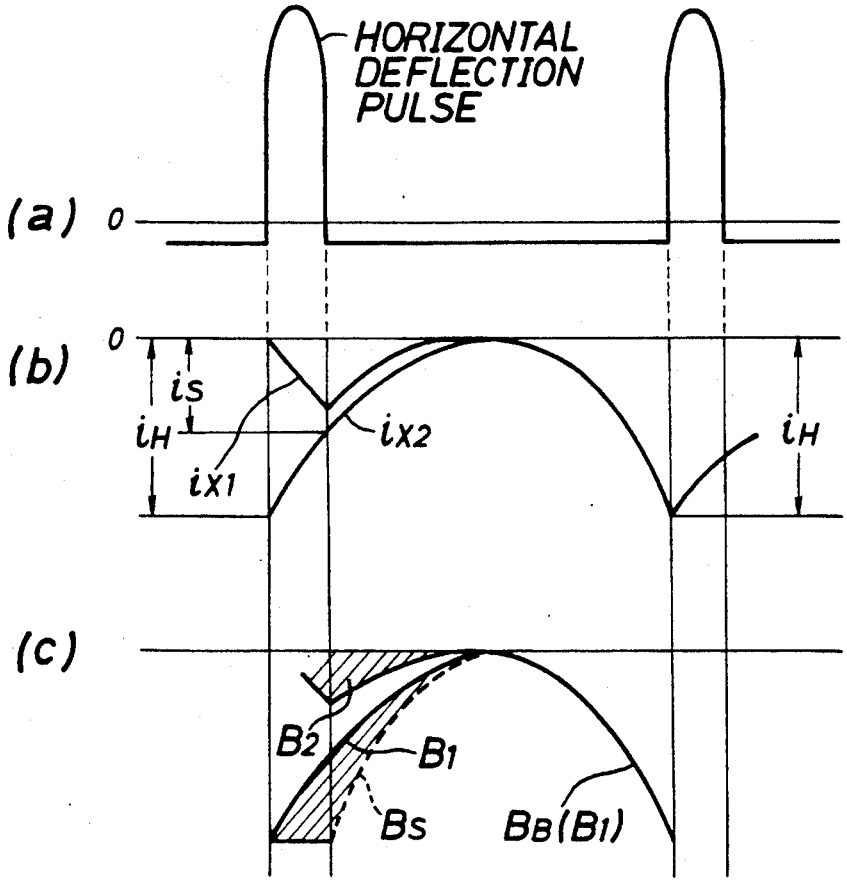
FIGS. 23(*a*) to 23(*c*) are timing charts for explaining an operation of the circuit shown in FIG. 20.

In this circuit, during a scanning period for the left half of the TV screen, the diode is forward-biased to be turned on, a current flows in the first $X_H$ correction coils 8*a* and 8*b* and the second $X_H$ coils 9*a* and 9*b* on the basis of a transient phenomenon. A current $i_{X1}$ flowing in the first $X_H$ correction coils 8*a* and 8*b* and a current $i_{X2}$ flowing in the second $X_H$ correction coils 9*a* and 9*b* respectively have waveforms shown in FIG. 23(*b*). The intensity of the current $i_{X1}$ can be adjusted by changing the inductance of the correction amount adjusting coil 7'. The current $i_{X2}$ has a peak value $i_H$ at the rise time of a horizontal deflection pulse, i.e., at the start time of a blanking period.

During scanning period for the right half of the TV screen, the diode 13 is turned on, and the diode 5 is tuned off. Consequently, no current flows in the first $X_H$ correction coils 8a and 8b, and the current $i_{X2}$ flows in the second $X_H$ correction coils 9a and 9b. This current $i_{X2}$ has the peak value $i_H$ at the end point of a scanning period. As described above, since the current $i_{X2}$ has a peak value $i_S$ smaller than the peak value $i_H$ at the start point of a scanning period, different peak values appear at the start and end points of a scanning period, and hence a current having unbalanced left and right components appears. For this reason, if the misconvergence $X_H$ is corrected by using only the current $i_{X2}$, the intensity of a correction field $B_1$ varies at the left and right sides of the TV screen. As a result, the left half of the TV screen is lacking in correction amount. Such a problem is solved in the circuit shown in FIG. 20 in the following manner. During a scanning period for the left half of the TV screen, the current $i_{X1}$ flows in the first $X_H$ correction coils 8a and 8b so as to cause them to generate a correction field $B_2$. This correction field $B_2$ is added to the correction field $B_1$ generated by the second $X_H$ correction coils 9a and 9b, as indicated by a dotted line in FIG. 23(*c*), thereby balancing the intensities of correction fields $B_S$ and $B_B$ respectively located on the left and right sides of the TV screen. In this circuit, the variable resistor 44 performs AMP adjustment on the left and right sides of the TV screen, i.e., variably adjusts the intensity of the current $i_{X2}$ flowing in the second $X_H$ correction coils 9a and 9b. The correction amount adjusting coil 7' serves to adjust the intensity of the current $i_{x1}$ flowing in the first $X_H$ correction coils 9a and 8b.

Figure 21:
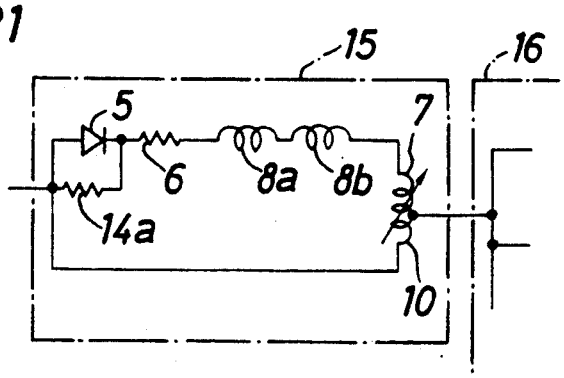

In a circuit shown in FIG. 21, the correction amount adjusting coil 7 of the first correction circuit 15 and the waveshaping coil 10 employed in FIGS. 5, 12, and 15 are integrated into an arrangement similar to a differential coil. Such integration of the coils 7 and 10 can decrease in number of components without interfering with adjustment of a correction amount.

Figure 22:
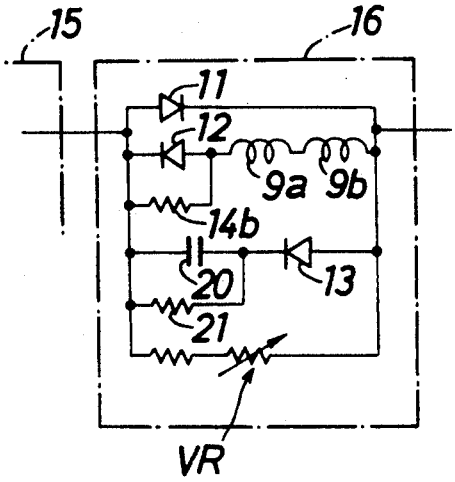

In a circuit shown in FIG. 22, a variable resistor VR is connected in parallel with a second correction circuit 16 of an $X_H$ correction circuit 1. The variable resistor VR serves to adjust an $X_H$ correction amount on the upper right side of a TV screen. When the resistance value of the variable resistor VR is decreased, a horizontal deflection current is bypassed and tends to flow in the variable resistor VR. As a result, the correction amount is reduced.

According to the present invention, the $X_H$ correction coils or the $X_H$ and HCR correction coils are connected to the horizontal deflection coil side of the deflection yoke, and the $Y_H$ correction coils or the $Y_H$ and VCR correction coils are connected to the vertical deflection coil side of the deflection yoke so that the deflection yoke can serve as a driving source for the respective correction coils. This arrangement requires no power sources for separately driving the respective correction coils, thus providing a low-cost deflection yoke device having a simple arrangement.

In addition, according to the present invention, in addition to correction of the misconvergence $X_H$ and the misconvergence $Y_H$, correction of the misconvergence HCR and the misconvergence VCR can be simultaneously performed, thereby sufficiently satisfying the demand for a high-resolution TV screen.

What is claimed is:

1. A deflection yoke device including horizontal deflection coils and vertical deflection coil which device comprises:

a first correction circuit connected to said horizontal deflection coil for correcting horizontal misconvergence of blue and red beams of an X axis of a screen of a color cathode-ray tube;

$X_H$ correction coils connected to an output of said correction circuit;

a second correction circuit connected to said vertical deflection coil for correcting horizontal misconvergence of blue and red beams on a X axis of the screen;

$Y_H$ correction coils connected to an output of said correction circuit; and common cores arranged on opposite sides of said cathode-ray tube, each of said cores being comprised of two or more leg portions joined at their ends by one or more bottom portions with said $X_H$ correction coils and said $Y_H$ correction coils being wound therearound.

2. A deflection yoke device according to claim 1, wherein said second $Y_H$ correction circuit includes an impedance in series with said $Y_H$ correction coil, said impedance having means for decoupling said $Y_H$ correction coil from said $X_H$ correction coil.

3. A deflection yoke device according to claim 1, wherein said $X_H$ correction coils are wound on leg portions of the U-shaped cores and said $Y_H$ correction coils are wound on bottom portions of the U-shaped cores.

4. A deflection yoke device according to claim 1, wherein said common cores comprise a pair of U-shaped cores arranged oppositely about said cathode-ray tube, both said $X_H$ correction coils and said $Y_H$ correction coils being wound on leg portions of the U-shaped cores.

5. A deflection yoke device according to claim 1, further comprising VCR correction coils connected in series with said vertical deflection coils for correcting vertical misconvergence of a green beam on a Y axis of the screen and wherein said $X_H$ correction coil, said $Y_H$ correction coil and said VCR correction coils are wound on said common cores.

6. A deflection yoke device according to claim 5, wherein said common cores comprise a pair of E-shaped cores arranged oppositely about said cathode-ray tube, said $X_H$ correction coils being wound on outer leg portions of said E-shaped cores, said $Y_H$ correction coils being wound on bottom portions of said E-shaped cores and said VCR coils being wound on intermediate leg portions of said E-shaped cores.

7. A deflection yoke device according to claim 1, further comprising HCR correction coils connected in series with said horizontal deflection coils for correcting horizontal misconvergence of a green beam on an X axis of the screen and wherein said $X_H$ correction coils, said $Y_H$ correction coils and said HCR correction coils are wound on said common cores.

8. A deflection yoke device according to claim 5, further comprising HCR correction coils connected in series with said horizontal deflection coils for correcting horizontal misconvergence of a green beam on an X axis of the screen and wherein said HCR correction coils are wound on said common cores.

9. A deflection yoke device according to claim 1, wherein said $X_H$ correction coils comprise first $X_H$ correction coils and second $X_H$ correction coils.

10. A deflection yoke device according to claim 9, further comprising a ring-shaped core having first primary windings connected in series with said first $X_H$ correction coils, second primary windings connected in series with said second $X_H$ correction coils and secondary windings connected in series with said $Y_H$ correction coils, all wound on the ring-shaped core.

* * * * *

UNITED STATES PATENT AND TRADEMARK OFFICE

CERTIFICATE OF CORRECTION

PATENT NO. : 5,142,205
DATED : August 25, 1992
INVENTOR(S) : Yabase, et. al.

It is certified that error appears in the above-indentified patent and that said Letters Patent is hereby corrected as shown below:

On the Title page, item [22], the filing date should be January 3, 1991--

Signed and Sealed this

Fifth Day of April, 1994

Bruce Lehman

*Attest:*

BRUCE LEHMAN

*Attesting Officer*

*Commissioner of Patents and Trademarks*